US008281554B2

(12) United States Patent
Carrara et al.

(10) Patent No.: US 8,281,554 B2
(45) Date of Patent: Oct. 9, 2012

(54) MACHINE FOR WRAPPING STICKS OF FOOD PRODUCTS

(75) Inventors: Marco Carrara, Stiore di Monteveglio (IT); Daniele Civolani, Molinella (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 281 days.

(21) Appl. No.: 12/788,511

(22) Filed: May 27, 2010

(65) Prior Publication Data

US 2010/0307106 A1 Dec. 9, 2010

(30) Foreign Application Priority Data

Jun. 5, 2009 (IT) ..... BO2009A0362

(51) Int. Cl.
*B65B 11/32* (2006.01)

(52) U.S. Cl. ..... 53/234

(58) Field of Classification Search ..... 53/203, 53/209, 225, 231, 234; *B65B 11/28, 11/30, B65B 11/32*

See application file for complete search history.

(56) References Cited

U.S. PATENT DOCUMENTS

| | | | | | |
|---|---|---|---|---|---|
| 2,334,029 | A * | 11/1943 | Ranney et al. | ..... | 53/51 |
| 3,797,198 | A * | 3/1974 | Fukuzaki | ..... | 53/209 |
| 4,006,577 | A * | 2/1977 | Schoppee | ..... | 53/234 |
| 4,070,851 | A * | 1/1978 | Schoppee | ..... | 53/228 |
| 4,085,567 | A * | 4/1978 | Putnam, Jr. et al. | ..... | 53/225 |
| 4,358,920 | A * | 11/1982 | Kanai et al. | ..... | 53/234 |
| 5,442,894 | A * | 8/1995 | Ogata et al. | ..... | 53/234 |
| 5,493,847 | A * | 2/1996 | Spatafora | ..... | 53/234 |
| 6,553,742 | B2 * | 4/2003 | Spatafora | ..... | 53/234 |

FOREIGN PATENT DOCUMENTS

| | | | |
|---|---|---|---|
| DE | 3201222 | A1 * | 7/1983 |
| DE | 10138943 | A1 * | 2/2002 |
| EP | 913327 | A1 * | 5/1999 |
| EP | 1504997 | A1 * | 2/2005 |

OTHER PUBLICATIONS

Machine translation of DE 10138943, retrieved from EPO website http://translationportal.epo.org/...ORMAT=docdb&KIND=A1 &LOCALE=en_EP&NUMBER=10138943&OPS=ops.epo.org &ENGINE=google&SRCLANG=de&TRGLANG=en, Apr. 26, 2012, 4 pages.*

* cited by examiner

*Primary Examiner* — Stephen F Gerrity
(74) *Attorney, Agent, or Firm* — Timothy J. Klima; Shuttleworth & Ingersoll, PLC

(57) ABSTRACT

In a machine for wrapping sticks of chewing gum, sticks of substantially rectangular outline and relatively small thickness advance singly and in succession on a conveyor, arranged flat and spaced apart at a predetermined first pitch, toward a position where they are transferred to a spacing roller revolving tangentially to the conveyor and presenting peripheral seats spaced apart at a pitch greater than the first pitch; the sticks are taken up at the transfer position by a pick-up and transfer mechanism operating between the conveyor and the seats of the spacing roller, describing a trajectory that includes a movement perpendicular to the plane occupied by the sticks and producing a minimal displacement equating approximately to the thickness of a single stick.

10 Claims, 6 Drawing Sheets

MACHINE FOR WRAPPING STICKS OF FOOD PRODUCTS

CROSS-REFERENCE TO RELATED APPLICATIONS

This application claims priority to Italian Patent Application No. B02009A000362 filed Jun. 5, 2009, which application is incorporated by reference herein.

BACKGROUND OF THE INVENTION

The present invention relates to a machine for wrapping sticks of food products.

In particular, reference is made throughout the following specification to products such as chewing gum, albeit with no limitation in scope implied.

Sticks of chewing gum typically present a flat rectangular appearance and are obtained from rectangular sheets corresponding in size to a multiple of the dimensions of the single sticks, each sheet consisting in a plurality of sticks arranged side by side, adjoining along a direction parallel to their respective longitudinal axes and connected one to the next by way of score lines.

The single sticks, fed in succession along a direction transverse to their longitudinal axes, are spaced apart one from the next by a given distance at the moment of being directed into the peripheral seats of an infeed wheel forming part of a wrapping unit.

The aforementioned distance, or pitch, is such as will allow each stick to be paired with a leaf of wrapping material at a successive wrapping wheel, and thereupon enveloped in the selfsame leaf of material while avoiding any interference with the stick preceding or following on the wheel.

In prior art machines, the sticks are flicked into the seats of the wheel by an ejector that engages the advancing sticks directly, striking each one in turn along one longitudinal edge in such a way that it enters the relative seat describing a trajectory substantially within the plane occupied by the selfsame sticks when engaged by the ejector.

Self-evidently, any variation in feed speed occasioned by a change of pitch, combined with the transfer method described above, will be liable to result in damage to the sticks, and in particular to the edges, given the impact generated by the mechanical elements of the ejector and by the surfaces of the aforementioned seats.

A further drawback accompanying the method described above derives from the inevitable tendency of the sticks to bounce uncontrollably off the bottom of the seat, becoming incorrectly positioned within the seat as a result.

It is clear that drawbacks of this nature, caused by any sudden acceleration, will impose insurmountable limits on the production tempo achievable by wrapping machines of the type operating by the method described above.

Accordingly, the object of the present invention is to provide a wrapping machine for sticks of chewing gum, such as will be unaffected by the drawbacks mentioned in connection with the prior art.

SUMMARY OF THE INVENTION

The stated object is realized, according to the present invention, in a machine for wrapping sticks of food products, comprising a feed unit supplying single sticks of substantially rectangular outline and of relatively small thickness, arranged flat on a conveyor, spaced apart initially at a predetermined first pitch and advancing toward a transfer position; the sticks are spaced apart at a predetermined second pitch, greater than the first pitch, by a spacing and wrapping unit comprising a roller by which the sticks are taken up flat into peripheral seats revolving substantially tangential to the conveyor at the transfer position, and means, operating at the transfer position, by which the sticks are picked up and transferred to the roller.

BRIEF DESCRIPTION OF THE DRAWINGS

The invention will now be described in detail, by way of example, with the aid of the accompanying drawings, in which.

DESCRIPTION OF THE PREFERRED EMBODIMENTS

FIGS. 1, 2, 3 and 4 illustrate a stick 1 of a food product, and in particular a stick of chewing gum presenting an elongated rectangular outline, referable to a longitudinal axis denoted A, and of relatively minimal thickness S.

Figure 1:
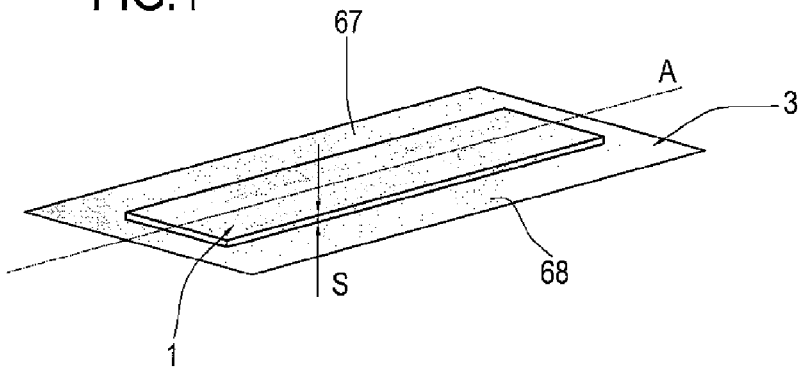
FIGS. 1 to 4 illustrate a stick of chewing gum, viewed in perspective, undergoing four successive wrapping steps.
Figure 2:
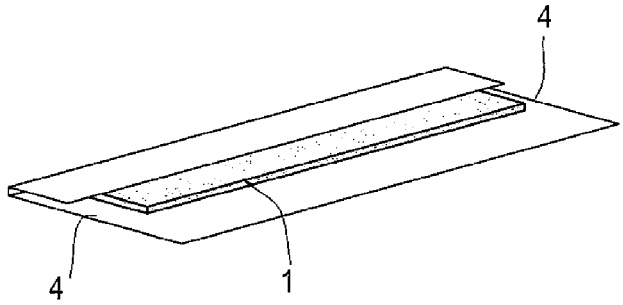
Figure 3:
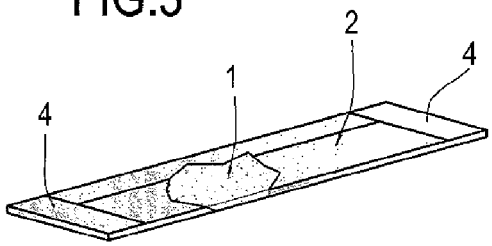

As illustrated in FIG. 3, the stick 1 is enveloped in a wrapper 2 fashioned from a leaf 3 of metal foil paper folded around the stick to form a tube, of which two projecting ends 4 are doubled back and flattened against the selfsame stick 1.

Figure 4:
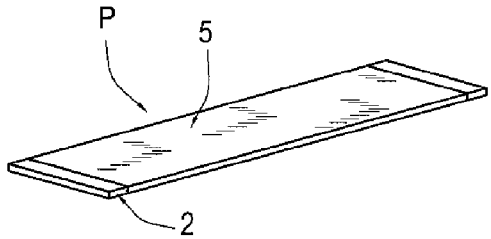

In FIG. 4, letter P indicates a finished product, consisting of a stick 1 enveloped by the aforementioned wrapper 2, and covered additionally by an outer label 5 folded to form a tube.

Figure 5:
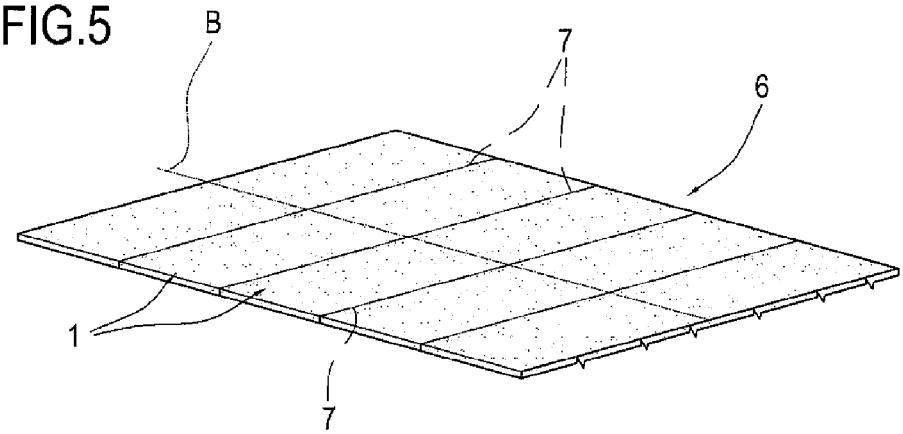
FIG. 5 illustrates a sheet, viewed in perspective, consisting in a plurality of sticks of chewing gum.

FIG. 5 illustrates a rectangular sheet 6 with a longitudinal axis denoted B, consisting in a plurality of sticks 1 arranged side by side and connected one to the next by way of score lines, denoted 7, extending transversely to the axis B.

The sheets 6 are separated into single sticks 1 by means of a simple pulling operation, in conventional manner.

Figure 6:
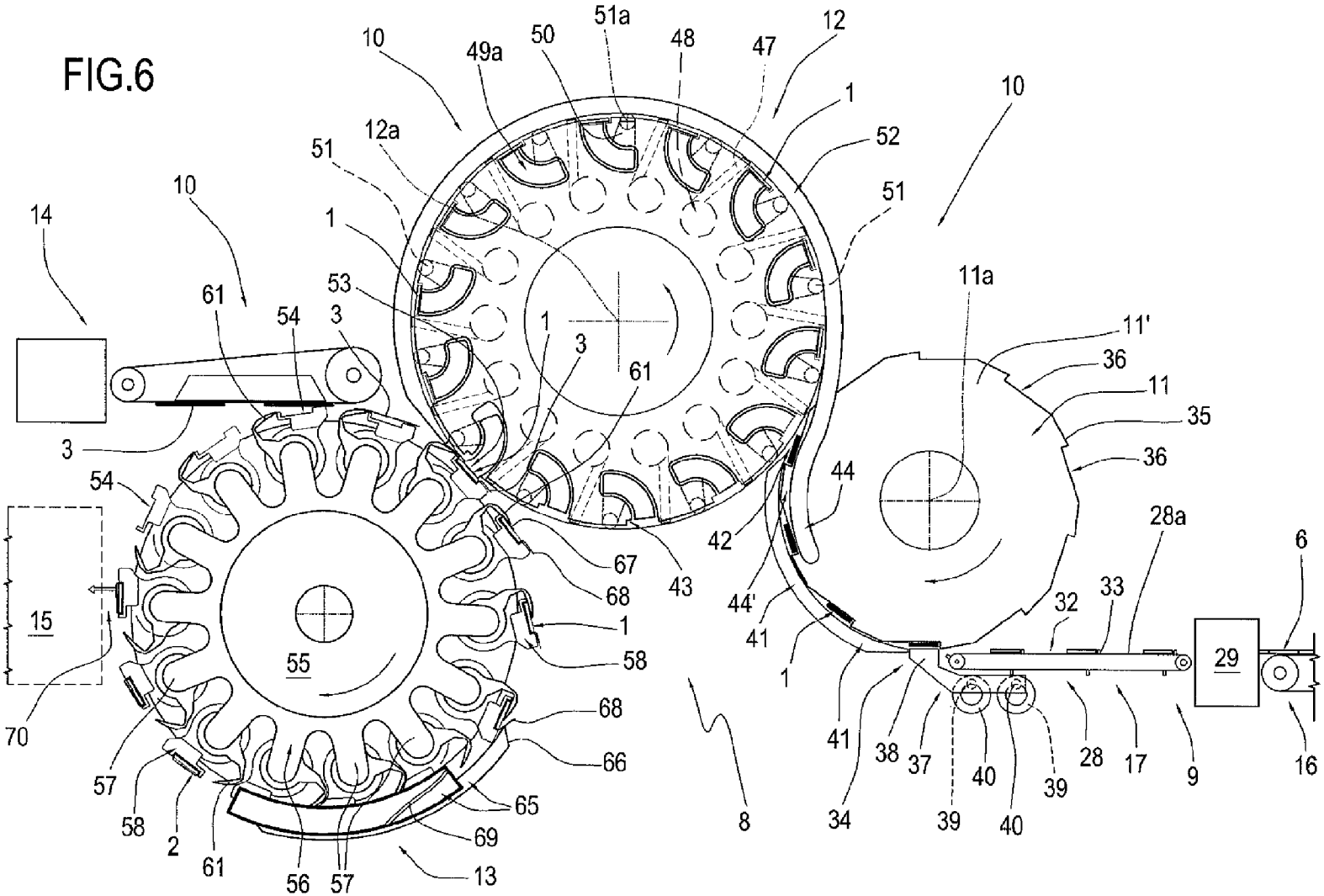
FIG. 6 illustrates a machine for wrapping sticks of chewing gum, viewed in a schematic front elevation.

With reference to FIG. 6, numeral 8 denotes a machine for wrapping the sticks 1, in its entirety, comprising a feed unit 9 by which the single sticks 1 are separated and conveyed, and a wrapping unit 10 by which the selfsame sticks 1 are enveloped in the inner wrappers 2 of metal foil paper aforementioned.

The wrapping unit 10 comprises three wheels or rollers denoted 11, 12 and 13, viewing right to left in FIG. 6, centered on horizontal and parallel axes 11*a*, 12*a* and 13*a* and revolving substantially tangential one to another.

The three rollers 11, 12 and 13 are referred to respectively hereinafter as a spacing roller, a transfer roller and a wrapping roller.

The machine 8 further comprises a feed unit 14 located above the wrapping roller 13, supplying the leaves of wrapping material 3, and downstream of the roller 13, a unit indicated schematically as a block denoted 15, by which the aforementioned labels 5 are folded around the sticks 1 to complete the finished products P.

Figure 7:
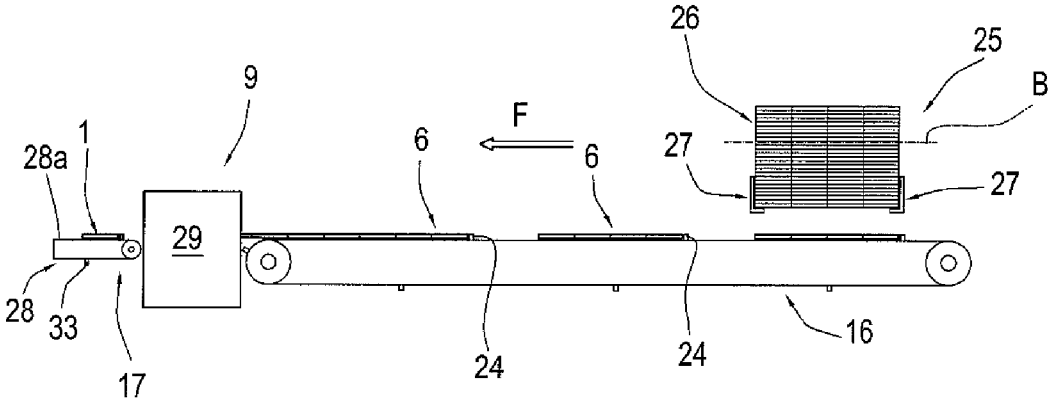
FIG. 7 illustrates a detail of FIG. 6, viewed in a schematic side elevation.
Figure 8:
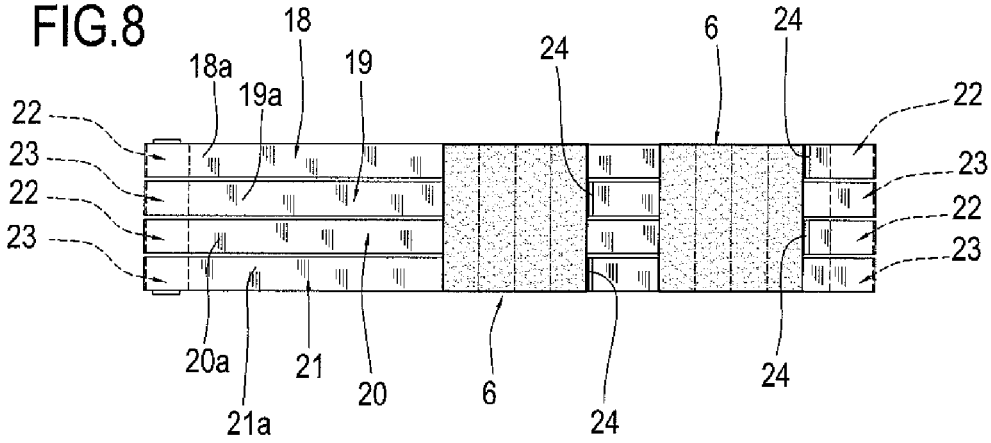
FIGS. 8 and 9 show the detail of FIG. 7 in a plan view, illustrating two successive operating steps.
Figure 9:
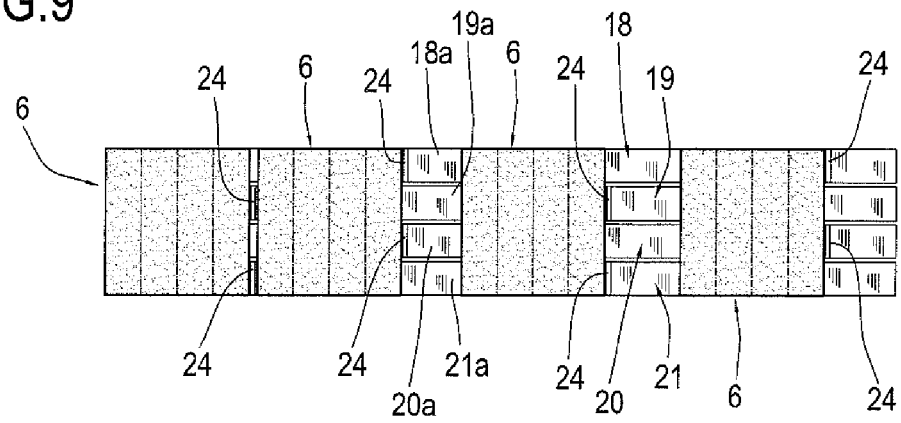

With reference also to FIGS. 7 through 13, the feed unit 9 supplying the single sticks 1 comprises first transfer means 16 and second transfer means 17 operating respectively at points upstream and downstream along the feed direction, indicated in FIG. 7 by an arrow denoted F.

The first transfer means 16 consist in the four top branches 18*a*, 19*a*, 20*a* and 21*a* of four horizontal belt conveyors 18, 19, 20, 21 extending parallel and side by side, looped around respective coaxially aligned rollers 22 and 23 at each end and advancing at a first speed V1.

The belt conveyors 18, 19, 20 and 21 operate as two non-adjacent pairs, conveyor 18 in concert with conveyor 20, and conveyor 19 in concert with conveyor 21.

Accordingly, the rollers 22 of the one pair of conveyors 18 and 20 are associated rigidly one with another and driven by conventional actuators (not illustrated), and similarly, the rollers 23 of the other pair of conveyors 19 and 21 are associated rigidly one with another and driven by conventional actuators (not illustrated).

Each pair of conveyors 18-20 and 19-21 is furnished with ridges 24 aligned transversely to the direction of movement and staggered relative to the ridges 24 of the other pair.

The aforementioned branches 18*a*, 19*a*, 20*a* and 21*a* of the conveyors 18, 19, 20, 21 are positioned beneath a hopper 25 containing a stack 26 of sheets 6 disposed with their longitudinal axes B parallel to the branches (FIG. 7).

The stack 26 is supported from underneath by movable retaining means 27 which, when operated by actuator means (not illustrated), are designed to release the sheets 6 singly at intervals timed to coincide with the passage of the ridges 24.

The feed speeds of the one pair of branches 18*a* and 20*a* and of the other pair of branches 19*a* and 21*a* are controlled one relative to the other, by relative actuator means, in such a way that each sheet 6 released onto the first transfer means 16 will be carried forward by the relative ridges 24 to the point of engaging in edge-to-edge contact with the preceding sheet 6.

Figure 13:
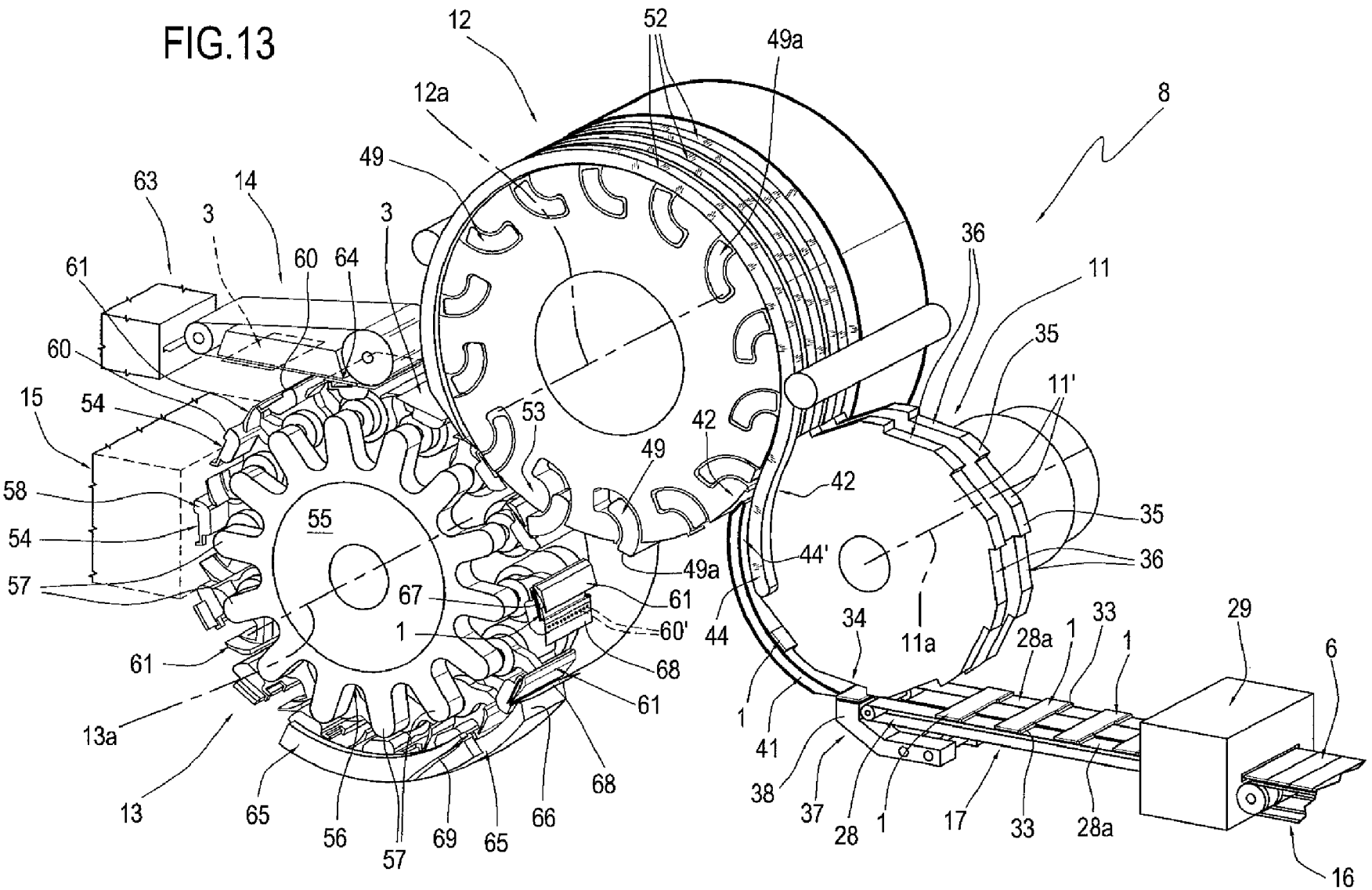
FIG. 13 shows the machine of FIG. 6, viewed in perspective.

Referring to FIG. 13, in particular, the second transfer means 17 consist in two top branches 28*a* of a horizontal belt conveyor 28, aligned with and occupying the same plane as the branches 18*a*, 19*a*, 20*a* and 21*a* of the first transfer means 16.

The two branches 28*a* are set apart one from another at a predetermined width, in such a way that the sticks 1 can be supported at their two opposite ends.

Positioned between the first transfer means 16 and the second transfer means 17 is a separator device 29 of familiar type (not shown in detail) by which the successive sheets 6 are divided into single sticks 1, and the sticks distanced one from the next at a given pitch P1.

Accordingly, the sheets 6 are fed into the separator device 29 with no break in continuity and divided up along the score lines 7 to produce the single sticks 1, which emerge spaced apart at the aforementioned pitch P1 and are directed flat into respective pockets 32 delimited between ridges 33 presented by the belt conveyor 28, advancing thus toward a transfer position 34 where each one will be taken up in turn by the spacing roller 11, rotating clockwise as seen in FIG. 6.

The spacing roller 11 revolves substantially tangential to the top branches 28*a* of the belt conveyor 28 at the transfer position 34, and is composed of two discs 11', distance axially one from the other and furnished peripherally with a plurality of teeth 35 establishing peripheral seats 36 equispaced at a pitch P2 greater than the pitch denoted P1.

To advantage, the peripheral seats 36 are defined by teeth 35 presenting a sawtooth profile designed to facilitate the entry of the sticks 1.

Figure 10:
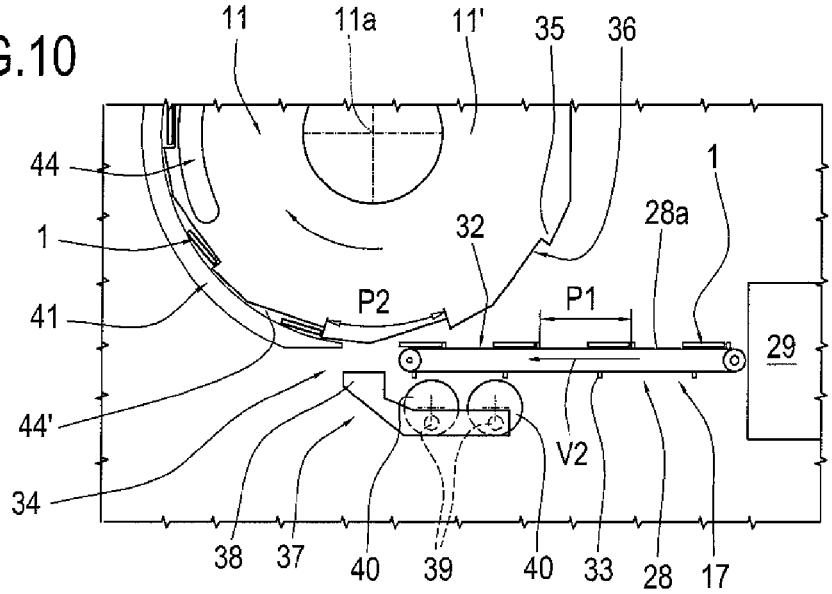
FIGS. 10, 11 and 12 show a second detail of FIG. 6 in a schematic side elevation view, illustrating three successive operating steps.
Figure 11:
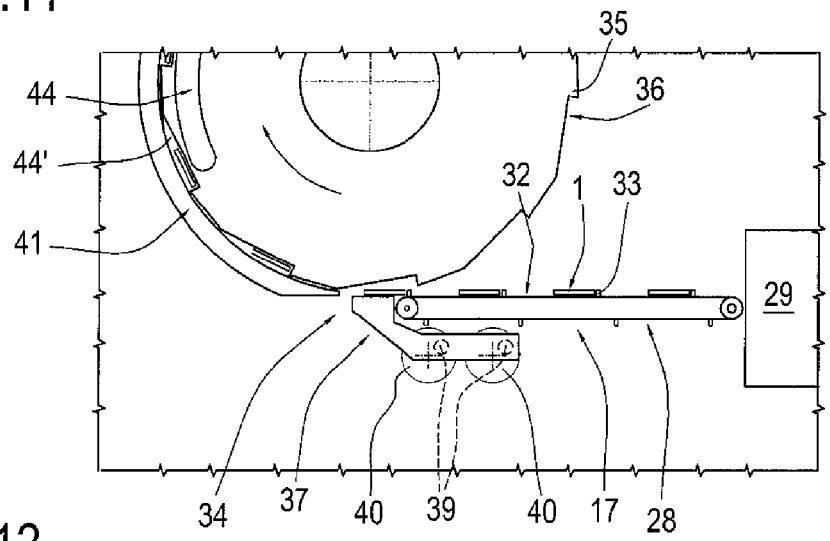
Figure 12:
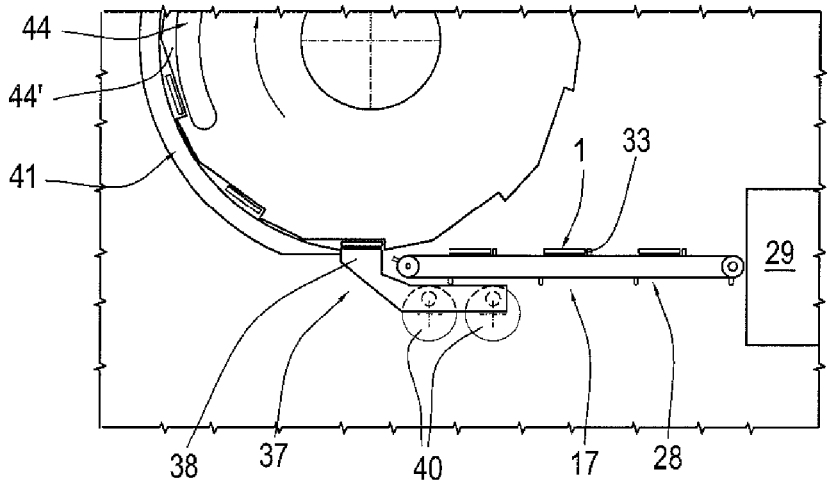

Referring particularly to FIGS. 10, 11 and 12, the machine is equipped with pick-up and transfer means 37 located at the transfer position 34, comprising an arm 38 coupled freely to a pair of pivots 39 aligned on parallel axes and mounted eccentrically to respective rollers 40.

The two pivots 39 and the relative rollers 40 constitute an actuator by which a composite movement is induced in the arm 38 when the two rollers 40 rotate clockwise.

More precisely, with the rollers 40 in rotation, the free end 38*a* of the arm 38 moves between the branches 28*a*, at first describing a trajectory substantially parallel to the conveyor 28 so as to engage the sticks 1 from beneath and elevate them from the pockets 32, and thereafter, a trajectory substantially normal to the plane occupied by the branches 28*a* and the sticks 1, in order to direct the sticks 1 into the seats 36 of the roller 11.

Alternatively, the pick-up and transfer means 37 might be of pneumatic type, making use of jets generated from a source of compressed air (not illustrated), which are delivered as the sticks 1 arrive at the transfer position 34.

As the roller 11 rotates through an angle substantially of 90°, each stick 1, held in the relative seat 36 by a restraint 41 associated concentrically with the roller 11, reaches a transfer position 42 where it is released to the transfer roller 12, which turns counter-clockwise and is furnished with peripheral seats 43 equispaced at the aforementioned pitch denoted P2.

Also associated with the transfer roller 12, internally adjacent to an end portion of the restraint 41, is a diverter element 44 combining with the restraint 41 to form a channel 44' along which the sticks 1 are guided from the seats 36 of the spacing roller 11 to the seats 43 of the transfer roller 12.

Figure 14:
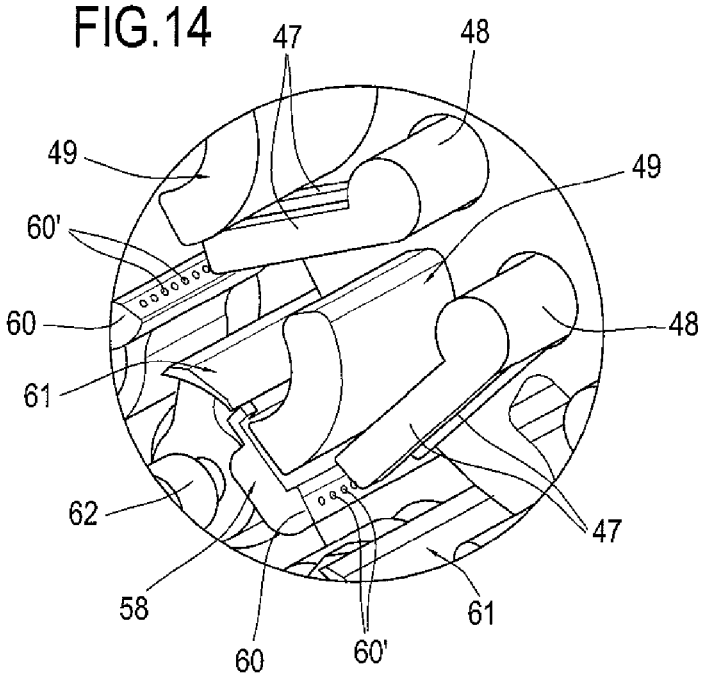
FIGS. 14, 15 and 16 are three enlarged details of FIG. 13.
Figure 15:
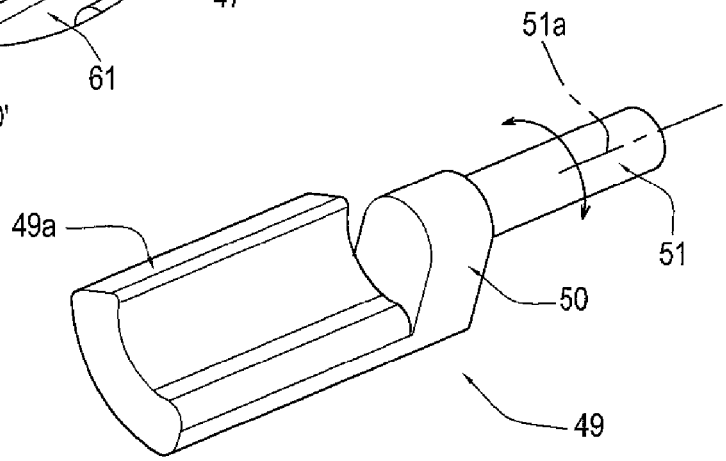
Figure 16:
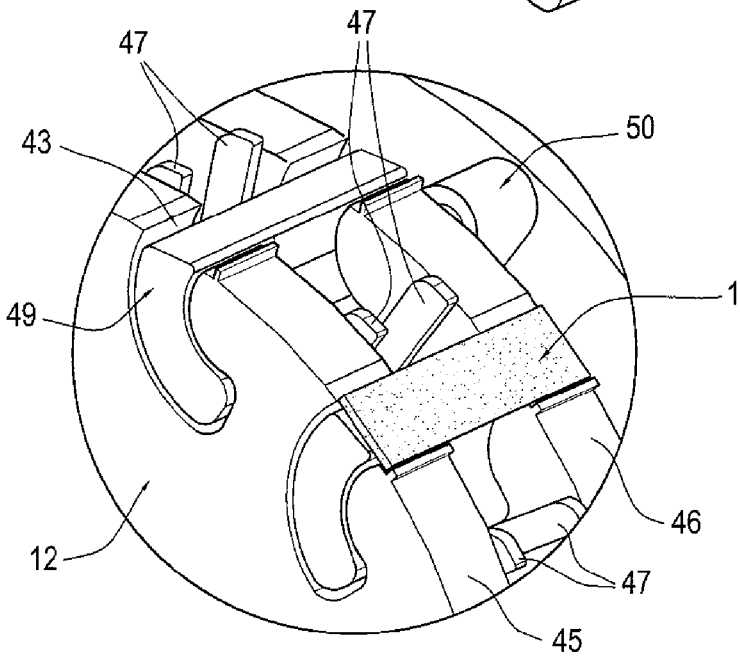

Referring also to FIGS. 14, 15 and 16, the transfer roller 12 is composed of two discs 45 and 46 distanced axially one from the other, and with cylindrical surfaces presenting the aforementioned seats 43.

Associated with each seat 43, interposed between the discs 45 and 46, is a pair of substantially radial arms 47 carried by a pivot 48 disposed parallel to the roller axis 12*a* (FIG. 6).

The arms 47, constituting means by which to align the sticks 1 in the respective seats 43, are caused through the agency of actuator means (not illustrated) to alternate between a position of disengagement from the relative seat 43, and a position of interaction with the stick 1.

Also associated with each seat 43 of the transfer roller 12, referring in particular to FIG. 15, is a pusher element 49 embodied as an arcuate bar 49*a* lodged in the discs 45 and 46 and operated by actuator means (not illustrated), by way of an arm 50 mounted to a pivot 51 rocking on a relative axis 51*a* lying parallel to the axis 12*a* of the roller 12.

The sticks 1 are retained in the corresponding seats 43 during the rotation of the roller 12 by a fixed restraint 52 aligned concentrically with the roller axis 12*a*.

Referring in particular to FIG. 14, when operated by the actuator means connected to each pivot 51, the free end of the pusher element 49 alternates between a first position substantially coplanar with the bottom of the relative seat 43, and a second position in which the stick 1 is engaged and ejected at a transfer position 53 where it passes to the wrapping roller 13, which rotates clockwise as viewed in FIG. 6 and is furnished with peripheral aspirating seats 54 equispaced at the pitch denoted P2.

The wrapping roller 13 comprises a cylindrical body 55 and, keyed to the body, a circular ring 56 furnished peripherally with a plurality of radial arms 57 equispaced angularly one from the next.

The end of each radial arm 57 carries a folding mechanism 58 affording the aspirating seat 54 in which to accommodate a single stick 1.

The downstream end of each seat 54, considered relative to the direction of rotation of the wrapping roller 13, presents a ridge 60 furnished with suction holes 60'.

Numeral 61 denotes a hooked folding element associated with each seat 54 on the side opposite to the ridge 60 and carried by a pivot 62 disposed parallel to the roller axis 13*a*.

Operated by actuator means (not illustrated) coupled to the pivots 62, the folding elements 61 are able to alternate between a first retracted position of disengagement from the seat 54, and a second active or folding position 60. Numeral 63 denotes a feed device supplying wrapping material, positioned above the wrapping roller 13.

The device 63 in question is designed to feed leaves 3 of metal foil paper into the seats 54 at a position 64 upstream of the position 53 where the sticks 1 are transferred, considered relative to the direction of rotation of the roller 13.

Downstream of the transfer position 53, at a position diametrally opposite the position 64 aforementioned, the roller 13 is equipped with a concentrically aligned restraint 65 of which the entry edge 66 functions as a fixed folder element.

In operation, referring to a single folding mechanism 58, the wrapping leaf 3 is held by suction in contact with the bottom of the relative seat 54 and advanced to the transfer position 53, where a stick 1 is directed into the selfsame seat, and onto the leaf 3, by a corresponding pusher element 49.

The transfer is accomplished with the aid of the relative pair of alignment arms 47, which serve to control the movement of the stick 1 and ensure it is faultlessly positioned in the seat 43 of the transfer roller, hence also in the seat 54 of the wrapping roller 13.

Referring also to FIG. 6, a stick 1 occupying the relative seat 54 is placed in contact with a central portion of the wrapping leaf 3, disposed with a trailing flap 67 and a leading flap 68 projecting externally of the seat 54 but without encroaching on the leaves preceding and following.

As the roller 13 rotates beyond the transfer position 53, the folding element 61 rotates clockwise in such a way as to bend and flatten the trailing flap 67 of the leaf 3 over the stick 1.

The leading flap 68, projecting over the aforementioned ridge 60 of the seat 54, is bent and flattened similarly over the stick 1 on encountering the fixed folder presented by the entry edge 66 of the restraint 65.

The restraint 65 is furnished on either side with two helical notches 69, one only of which visible in the drawings, functioning in conventional manner as folding elements by which the two ends 4 of the wrapper 2 are bent inwards and flattened (see also FIG. 3).

Numeral 70 denotes a position diametrally opposed to the transfer position 53, at which the sticks 1 enveloped in the wrappers 2 of metal foil paper are taken up by further transfer means and directed into the unit 15 where an outer label 5 is folded around each stick 1 to complete the finished product P.

To ease the passage of the single sticks 1 from the transfer roller 12 to the wrapping roller 13 (referring in particular to FIG. 14), it will be seen that each folding mechanism 58 incorporates an actuator of conventional type (not illustrated) designed to generate a rocking motion such as will substantially nullify the difference in peripheral velocity between the seats 54 of the one roller 13 and the seats 43 of the other roller 12 when passing through the transfer position 53.

More exactly, each folding mechanism 58 approaches the transfer position 53 pivoting in a counter-clockwise direction, so as to cancel out the aforementioned difference in velocity.

Once the transfer has taken place, the folding mechanism 58 pivots clockwise, returning to its former position.

Moreover, as mentioned in the preamble of the present specification, the prior art method by which the spacing of the sticks is changed from a first pitch to a longer pitch involves propelling the single sticks in a direction parallel to their transverse dimension, into the substantially radial seats of a spacing roller, which can result in the stick being incorrectly positioned and bouncing against the bottom of the seat.

According to the present invention, the transfer bringing about the change in pitch from P1 to P2 is accomplished by easing the sticks 1 gently into the peripheral seats 36 of the spacing roller 11 through the action of the pick-up and transfer means 37, describing a trajectory substantially normal to the plane occupied by the sticks 1 and producing a minimal displacement, equating approximately to the thickness S of the selfsame sticks 1.

The invention claimed is:

1. A machine for wrapping sticks of food products, comprising:

a feed unit supplying a succession of single sticks having a substantially rectangular outline and of relatively small thickness, arranged flat on a conveyor and advancing, spaced apart at a predetermined first pitch, toward a transfer position;

a spacing and wrapping unit by which the sticks are spaced apart at a predetermined second pitch greater than the first pitch, comprising a spacing roller by which the sticks are taken up lying flat into tangential peripheral seats revolving substantially tangential to the conveyor at the transfer position, and a pick-up and transfer mechanism, operating at the transfer position, by which the sticks are picked up and transferred to the spacing roller;

wherein the spacing and wrapping unit comprises a wrapping roller, and a transfer roller interposed between the spacing roller and the wrapping roller;

wherein the transfer roller includes a plurality of tangential peripheral seats and, associated with each transfer roller seat, a pusher element, and an alignment mechanism for positioning one of the sticks in the transfer roller seat.

2. A machine for wrapping sticks of food products as in claim 1, wherein the wrapping roller comprises a plurality of radial arms each carrying a folding mechanism fashioned with a seat to accommodate a leaf of wrapping material and a stick, and including a movable folding element alternating between a first retracted position of disengagement from the folding mechanism seat, and a second folding position placed over the folding mechanism seat.

3. A machine for wrapping sticks of food products as in claim 2, wherein each folding mechanism can rock on an axis parallel with the axis of the wrapping roller, to reduce a difference in speed, at least in part, between a seat of the wrapping roller and a corresponding seat of the transfer roller when passing through the transfer position.

4. A machine for wrapping sticks of food products as in claim 2, comprising a feed unit for supplying a leaf of wrapping material to the seat of each folding mechanism, wherein the leaf is positioned with a first trailing flap and a second leading flap projecting respectively upstream and downstream from the seat of the folding mechanism.

5. A machine for wrapping sticks of food products as in claim 4, wherein the folding element engages the first flap, and the second flap is engaged and flattened over the first flap by an entry edge of a fixed restraint associated concentrically with the wrapping roller, thereby forming a tubular wrap around the stick with two ends projecting transversely from the seat of the folding mechanism.

6. A machine for wrapping sticks of food products as in claim 5, comprising two helical folders by which the two ends of the tubular wrap are engaged, bent and flattened over the stick.

7. A machine for wrapping sticks of food products as in claim 1, wherein the alignment mechanism comprises at least one arm movable between a first position of disengagement from the transfer roller seat, and an active second position in which the stick is aligned in the transfer roller seat and guided from the transfer roller to the wrapping roller at the transfer position.

8. A machine for wrapping sticks of food products as in claim 1, wherein the seats of the wrapping roller are aspirating seats.

9. A machine for wrapping sticks of food products as in claim 1, wherein the food products are sticks of chewing gum.

10. A machine for wrapping sticks of food products as in claim 1, wherein the pick-up and transfer mechanism comprises a movable arm in which a composite movement is induced by an actuator, causing the pick-up and transfer mechanism to move from the conveyor toward the seats of the spacing roller describing a trajectory that includes a displacement component normal to a plane occupied by the sticks.

* * * * *